US005440995A

United States Patent [19]

Levitt

[11] Patent Number: 5,440,995

[45] Date of Patent: Aug. 15, 1995

[54] TUNGSTEN PENETRATORS

[75] Inventor: Albert P. Levitt, Newton, Mass.

[73] Assignee: The United States of America as represented by the Secretary of the Army, Washington, D.C.

[21] Appl. No.: 39,603

[22] Filed: Apr. 5, 1993

[51] Int. Cl.[6] ..... F42B 12/00

[52] U.S. Cl. ..... 102/517; 102/519; 428/911

[58] Field of Search ..... 75/229; 428/911; 102/517, 519

[56] References Cited

U.S. PATENT DOCUMENTS

| | | | |
|---|---|---|---|
| H343 | 10/1987 | Keown et al. | 102/517 |
| 3,826,172 | 7/1974 | Dawson | 29/194 |
| 4,463,678 | 8/1984 | Weimer et al. | 102/307 |
| 4,841,868 | 6/1989 | Jackson | 102/517 |
| 4,867,061 | 9/1989 | Stadler et al. | 102/307 |
| 4,961,383 | 10/1990 | Fishman et al. | 102/517 |

OTHER PUBLICATIONS

Bruchey et al., "The Effect of Crystallographic Orientation on the Performance of Single Crystal Tungsten Sub-Scale Penetractors", Interim Reprt. No. 941, Ballistic Research Laboratory, (Apr. 1990).

Vennett et al., "Multiple Necking of Tunsten Fibers in a Brass—Tungsten Composite", Metallurgical Transactions, vol. 1, pp. 1569-1575 (Jun. 1970).

*Primary Examiner*—Ngoclan Mai

*Attorney, Agent, or Firm*—Freda L. Krosnick; Muzio B. Roberto

[57] ABSTRACT

An improved tungsten penetrator employing tungsten whiskers of various crystalline orientations—specifically the [100] orientation. The penetrator has enhanced penetration ability and strength.

10 Claims, 2 Drawing Sheets

TUNGSTEN PENETRATORS

GOVERNMENTAL INTEREST

The invention described herein may be manufactured, used and licensed by or for the U.S. Government for governmental purposes without the payment to us of any royalties.

BACKGROUND OF THE INVENTION

The invention relates to the field of penetrators. More specifically, the invention relates to a strengthened penetrator, wherein the strengthened penetrator employs specific materials in a set configuration.

Numerous types of penetrators exist. Tungsten is often a material of choice in the penetrator art. A typical method for fabricating penetrators from tungsten involves the use of tungsten powder metal, which is a heterogeneous mixture of tungsten and other metal powders. The mixture of powders is compacted into the desirable shape, liquid phase sintered and processed into penetrators.

Additional materials commonly employed in the penetrator art are depleted uranium and liquid phase sintered tungsten metals and alloy variations thereof. The use of uranium in penetrators is undesirable due to its radioactive properties. The need exists to study the properties of various compounds while, at the same time, taking into consideration the requirements or standards of those interested in producing a penetrator having enhanced strength and penetration ability. Materials of choice would be those that would optimize the desired properties of penetrators.

Prior art projectiles, such as those taught in Statutory Invention Registration H343, have been modified by employing composite fiber reinforcement materials therein. These fiber reinforcement materials have been woven throughout the make up of a penetrator to enhance the strength and penetrating ability of the resulting product. In this reference, the fibers employed are wires such as those composed of tungsten-hafnium-carbide (column 3, lines 32+) and tungsten generally (column 3, lines 61+).

U.S. Pat. No. 4,961,383, issued to Fishman et al., teaches a composite tungsten-steel armor penetrator. The penetrator taught therein comprises an iron or steel matrix which is reinforced with heavy metal wires or rods. These wires or rods may be composed of tungsten, among numerous other materials taught.

The use of heavy metal wires as a reinforcing means in the penetrator art is equally taught in Jackson, U.S. Pat. No. 4,841,868. Jackson teaches a composite long rod penetrator composed primarily of depleted uranium and titanium. This penetrator may be reinforced with tungsten wire filaments.

Single crystal bodies are taught as having strengths which are relatively greater than polycrystalline bodies. Note, U.S. Pat. No. 4,867,061, issued to Sadler et al. More specifically, Sadler et al. teaches the employ of tungsten or an alloy of tungsten into penetrator constructions. Reference is made to the [100] crystal orientation of tungsten—note column 3, lines 49+.

The criticality of and the effect of the type of crystal orientation employed in single crystal penetrators was addressed by Bruchey et al. in "The Effect of Crystallographic Orientation on the Performance of Single Crystal Tungsten Sub-Scale Penetrators," Interim Memorandum Report No. 941, Ballistic Research Laboratory, Aberdeen Proving Ground, Md. (April, 1990). This memorandum, beginning at the paragraph bridging pages 5 and 6 therein, teaches that the study conducted using the [100] orientation of tungsten indicated that this orientation had the best penetration performance.

In summary, the prior art generally teaches the well known use of tungsten, and more specifically tungsten having [100] orientation, in the penetrator art. The prior art additionally sets forth that metallic wires containing tungsten, in various forms, have been employed to reinforce the strength of penetrators. Moreover, it is also known in the art that single crystal bodies elicit better properties than polycrystalline bodies.

Although much research has been conducted in the penetrator art to develop a penetrator having enhanced strength and penetration ability, the invention herein sets forth a superior, single crystal, tungsten based penetrator not taught or even suggested by the above teachings.

The prior art references do attempt to develop a penetrator having enhanced properties and characteristics, however, nowhere do these references teach the use of tungsten whiskers in penetrators. Moreover, nowhere do any of the teachings even suggest the employ of whiskers, tungsten whiskers or more specifically tungsten [100] whiskers, in the penetrator art.

Applicant has discovered that the use of tungsten [100] whiskers, which must be carefully produced under controlled laboratory conditions, in penetrators creates a superior penetrator having enhanced strength and penetration ability.

BRIEF SUMMARY OF THE INVENTION

The present invention is an improved penetrator. This penetrator, which is composed of tungsten, has superior, sought after properties. It may be produced by employing metal matrix composite technology. The tungsten penetrator herein differs from tungsten penetrators in the prior art in that it is composed of tungsten whiskers. Although different crystalline orientations of tungsten whiskers may be employed within the scope of the present invention, the [100] orientation is the one preferred.

Tungsten penetrators already in use (i.e., those in the polycrystalline form) tend to form mushroom heads upon impact of a hard target. The formation of a mushroom head decreases the penetration ability of a penetrator. Hence, the performance of a penetrator would be enhanced if the formation of a mushroom head could be eliminated. The penetrator of the present invention is designed to prevent the formation of a mushroom head during its penetration of armor materials or other hard materials—i.e. steel.

Although penetrators do exist which do not form a mushroom head upon impact, these penetrators carry with them other undesirable properties. For example, the most effective penetrators to date are those composed of uranium. Even though uranium based penetrators do not form mushroom heads upon impact, their radioactive nature makes them undesirable in that additional considerations need to be addressed in their use—i.e. the disposal of radioactive waste, etc.

Accordingly, it is an object of the invention to provide a penetrator having superior penetration ability and strength.

It is another object of the present invention to provide a penetrator having superior penetration ability and strength which is not radioactive in nature.

It is another object of the invention to provide a tungsten penetrator having superior penetration ability and strength.

It is a further object of the invention to produce a penetrator which employs tungsten whiskers therein.

It is still a further object of the present invention to produce a penetrator which employs tungsten whiskers therein, wherein said tungsten whiskers are of the [100] orientation.

Still a further object of the invention is to provide a tungsten penetrator which will not form a mushroom head upon impact of targets.

The means to achieve these and other objectives of the present invention will be apparent from the following detailed description of the invention, drawings and the claims.

DETAILED DESCRIPTION OF THE INVENTION

The present invention relates to an improved penetrator and a method for making said penetrator. More specifically, the invention is a tungsten penetrator having superior properties, such as penetration ability and strength.

The tungsten penetrator within the scope of the present invention is composed of numerous tungsten whiskers. Whiskers in the chemical arts refer to

[m]inute hair-like crystals of certain metals which have been obtained under special conditions in a very pure state. Iron whiskers, for example, are said to have remarkable tensile strength. (Rose, *The Condensed Chemical Dictionary,* Sixth Edition, pg. 1226 (1961)) They, as the definition sets forth, must be produced or grown under highly specific laboratory conditions. They are not readily available stock items.

Single crystal tungsten [100] whiskers, to be employed within the present invention, may be produced by suspending several very thin (about 0,001 inches in diameter) polycrystalline tungsten filaments, which are readily available from GTE Corporation, Towanda, Pa., from a support plate. These polycrystalline filaments are surrounded with an induction heater coil. On a lower platform, a tungsten [100] seed crystal is provided. This lower platform is raised so that the seed crystal having the [100] orientation comes in contact with the suspended polycrystalline tungsten filaments. At the very time that the crystal and the filaments come in contact, the points of contact are being heated inductively to the molten state at the single crystal/polycrystalline interface. The polycrystalline tungsten filaments melt and recrystallize onto the [100] single crystal face as a single crystal with the same [100] orientation. The entire polycrystalline array is slowly lowered through the induction coil so that the molten zone (the single crystal/polycrystalline interface) traverses the entire lengths of polycrystalline tungsten filaments. This facilitates the entire conversion of the polycrystalline tungsten to the single crystal [100] orientation whisker. It is these whiskers that are employed by the penetrator herein.

The induction heater employed must have sufficient power to heat the single crystal/polycrystalline interfaces to the melting point of tungsten (approximately 3410° C.) and maintain the molten zone as it travels upwardly along each polycrystalline filament while the [100] "seed" crystals are lowered with newly converted (from the tungsten polycrystalline filaments) [100] single crystal whiskers attached to them. This process may also be considered to be a zone refining process wherein the upwardly traveling molten zone permits the conversion of very thin polycrystalline filaments into high purity [100] single crystal whiskers. The high purity results because the impurities in the original polycrystalline filaments are more soluble in molten tungsten than in solid tungsten. Thus the impurities remain in the molten tungsten zone as it travels up the tungsten filaments until they become concentrated in the top ends of the newly formed [100] tungsten whiskers. These end zones of impurities may be easily cut off after the newly formed tungsten whiskers are removed from the induction coil. The induction furnace could also be replaced by an electron beam furnace with comparable results.

In order to avoid oxidation of the molten tungsten and to remove any residual oxygen during the described process of producing tungsten [100] whiskers, the tungsten filaments should be surrounded with hydrogen gas.

The extremely high melting point of tungsten (approximately 3410° C.) makes it impracticable to sinter the tungsten whiskers together to form a structurally sound penetrator without coating them with a lower melting point coating. For example, in prior art tungsten penetrators have been made by liquid phase sintering polycrystalline tungsten powder, each particle of which has been coated with a lower melting point coating such as iron/nickel in the ratio of 7 iron/3 nickel by weight in a hydrogen atmosphere at a temperature of 1475° C. for approximately one hour. The resulting penetrator body consisted of 90% tungsten, 7% iron and 3% nickel by weight.

In this invention, the metal coated tungsten powder particles are replaced by the above described [100] tungsten whiskers that may also be coated with a variety of coatings such as iron/nickel, iron/nickel/cobalt, nickel/cobalt, nickel/copper, copper, hafnium, titanium, cobalt, palladium, combinations of these and other materials having like properties. Such coatings may be applied by the fluidized bed process developed by the Ultramet Corporation, Pacoima, Calif. or by other chemical or physical vapor deposition processes. The coating thickness should be as thin as possible to permit sintering and bonding between the coated whiskers without disturbing the crystalline perfection of the [100] whiskers. The very thin coating serves to maximize the penetrator density by maximizing the volume fraction (90%+) of the tungsten whiskers.

The coated tungsten [100] whiskers may then be placed in a parallel fashion, longitudinally into a ceramic mold having the desired penetrator shape and dimensions. Once in the mold, the entire mold is heated in a hydrogen atmosphere furnace in order to facilitate liquid phase or diffusion bonding of the whiskers. The temperature of the furnace may be adjusted in order to optimize liquid phase or diffusion bonding. Optimum temperature will vary depending upon the composition of the coating used on the single crystal tungsten whisker. For example, for iron/nickel coatings, the liquid phase sintering temperature should range between 1475° C. to 1575° C. for one hour (in a hydrogen atmosphere) depending on the iron/nickel ratio and the tungsten whisker volume fraction. Sintering time and temperature should be kept to the minimums required to produce good bonding while not affecting the tungsten whisker crystalline perfection.

As an alternative, the coated tungsten [100] whiskers may be further extruded through a binder, such as methyl methacrylate, and into cylinders in a parallel fashion. These cylinders may then be cut to the approximate length of the final penetrator. Once cut, the cylinders are placed into a die having a cylindrical cross-section and pressed to form a weakly bonded structure. Or, the cylinders may be isostatically pressed. The pressed form is then removed from the die and sintered in a hydrogen atmosphere furnace in order to set its contents to provide a highly dense penetrator. The temperature and the length of the sintering is such as to optimize the properties of the penetrator as described above. The final product may require machining to achieve the appropriate penetrator dimensions.

The resulting tungsten penetrators, which may require finish machining or grinding, will consist of tungsten [100] oriented single crystal whiskers bonded together by the metal matrix selected. These penetrators perform as well as depleted uranium penetrators, without the health hazards and risks involved in using radioactive materials.

The resulting metal composite matrix will comprise very high volume fraction (90% or higher) tungsten single crystal whiskers which reinforce a low volume fraction (10% or lower) metal matrix. That is, the very thin metal matrix (coating) is the bonding agent which binds the [100] tungsten whiskers to form a unified, structurally sound tungsten penetrator with a tungsten volume fraction of 90% or higher.

Other features of the present invention will be apparent from the following drawings and their description.

DETAILED DESCRIPTION OF THE DRAWINGS

The drawings will be further discussed in order to provide a better understanding and description of the present invention.

Figure 1:
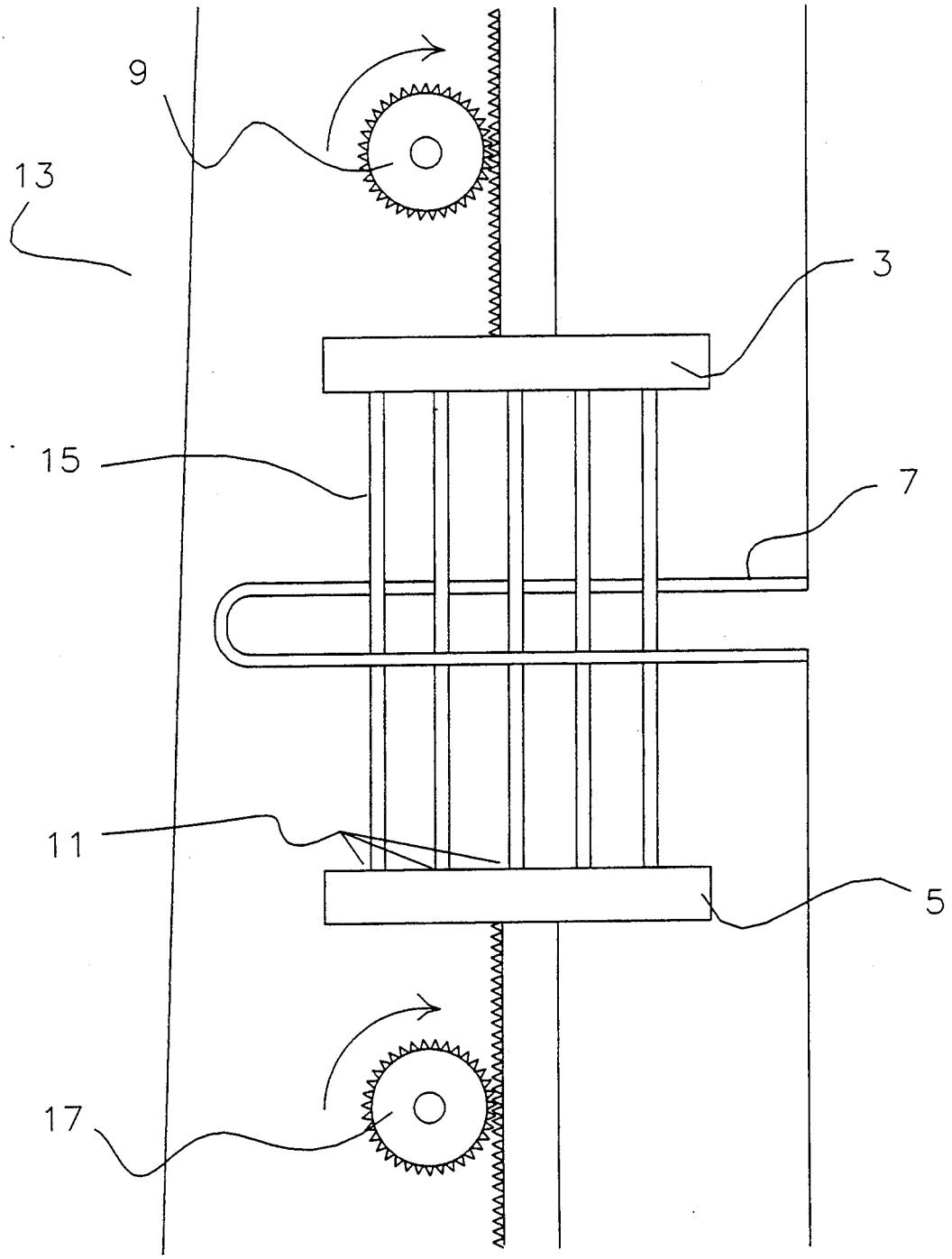
FIG. 1 depicts a schematic drawing of an apparatus which may be used for the production of tungsten, single crystal whiskers.

FIG. 1 is a schematic representation of the type of apparatus which may be employed to produce the tungsten [100] whiskers. Said apparatus 13 comprises support plate 3 for the support of very thin polycrystalline tungsten filaments or wires 15, lower platform 5 for housing tungsten [100] seed crystals, induction heater coil 7, rack and pinions 9 and 17 to facilitate the raising and/or lowering of support plate 3 or lower platform 5, and tungsten [100] seed crystals 11.

The manner in which this apparatus 13 is used has been described in detail in the above description of the invention. Therefore, how the apparatus operates will be briefly summarized to associate a specific apparatus 13 with the described process.

Polycrystalline tungsten filaments 15 are suspended from support plate 3. Said polycrystalline filaments 15 are surrounded by a heating coil 7, which facilitates the heating of said tungsten filaments 15 to their molten state (melting point of approximately 3410° C.). The lower platform 5, which houses thereon tungsten [100] seed crystals 11, may be raised using rack and pinion 17. This facilitates the contact of polycrystalline filaments 15 with tungsten [100] single crystals 11. The points of contact between the two components, 15 and 11, are inductively heated to the molten state using said induction heater coil 7. The polycrystalline filaments 15 recrystallize as tungsten [100] whiskers on the tungsten [100] single seed crystals 11. Once this process has been initiated, the remaining polycrystalline tungsten filaments 15 are lowered through the induction coil 7 using rack and pinion 9. The resulting products are tungsten single crystal whiskers having the [100] crystal orientation. These whiskers, by definition are single crystals with a high crystalline perfection level. An electron beam furnace may also be used instead of an induction furnace.

Figure 2:
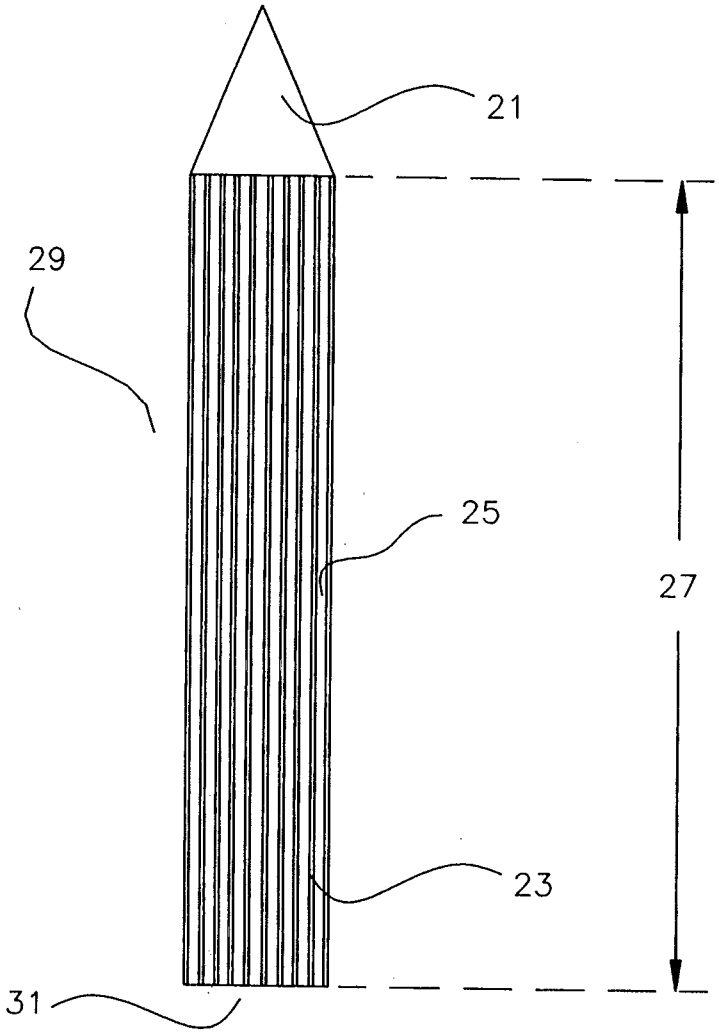
FIG. 2 is a schematic drawing of a penetrator which employs tungsten whiskers therein.

The tungsten [100] whiskers produced may be employed into penetrators as depicted in FIG. 2. FIG. 2 sets forth a tungsten [100] whisker reinforced penetrator 29 having a forward ogive end 21 (also referred to as a nose cap), penetrator matrix material 25, tungsten [100] whiskers 23 and aft end 31. Said forward ogive end 21 may be machined from the sintered penetrator body or may be composed of a machined, mechanically attached tungsten [100] single crystal. As noted earlier, the penetrator matrix material 25 (which is also the coating on the [100] tungsten whiskers) may be composed of metals such as iron/nickel, iron/nickel/cobalt, nickel/cobalt, nickel/copper, copper hafnium, titanium, cobalt, palladium, combinations of these and other materials having like properties.

Tungsten [100] whiskers must be employed into the present invention in the coated form. The novelty of the present invention resides in the use of tungsten [100] whiskers in the penetrator arts.

While particular embodiments of the present invention have been shown and described, it will be obvious to those skilled in the art that changes and modifications may be made without departing from this invention. Therefore, it is intended that the claims herein are to include all such obvious changes and modifications as fall within the true spirit and scope of this invention.

I claim:

1. A penetrator comprising a long rod having a forward ogive end and an aft end, wherein said long rod comprises therein a plurality of tungsten whiskers disposed throughout said long rod.

2. A penetrator in accordance with claim 1, wherein said tungsten whiskers have the [100] crystalline orientation.

3. A penetrator in accordance with claim 2, wherein said tungsten [100] whiskers are coated with metals.

4. A penetrator in accordance with claim 3, wherein said metals are selected from the group consisting of iron/nickel, iron/nickel/cobalt, nickel/copper, nickel/cobalt, copper, hafnium, titanium, cobalt, palladium and combinations thereof.

5. A penetrator comprising a long rod having a forward ogive end and an aft end, wherein said long rod comprises therein a plurality of tungsten whiskers disposed throughout said long rod, wherein said tungsten whiskers are found throughout said long rod between said forward ogive end and said aft end.

6. A penetrator in accordance with claim 5, wherein said forward ogive end is machined from said long rod.

7. A penetrator in accordance with claim 5, wherein said forward ogive end is composed of a tungsten single crystal.

8. A penetrator in accordance with claim 5, wherein said tungsten whiskers have the [100] crystalline orientation.

9. A penetrator in accordance with claim 8, wherein said tungsten [100] whiskers are coated with metals.

10. A penetrator in accordance with claim 9, wherein said metals are selected from the group consisting of iron/nickel, iron/nickel/cobalt, nickel/copper, nickel/-cobalt, copper, hafnium, titanium cobalt, palladium and combinations thereof.

* * * * *